US006211479B1

(12) United States Patent
Ohara et al.

(10) Patent No.: US 6,211,479 B1
(45) Date of Patent: Apr. 3, 2001

(54) PERSISTENT CURRENT CIRCUIT SWITCH

(75) Inventors: Akinori Ohara; Yoshiyuki Tsuda, both of Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/350,094

(22) Filed: Jul. 9, 1999

(30) Foreign Application Priority Data

Oct. 6, 1998 (JP) ..... 10-284388

(51) Int. Cl.[7] ..... H01H 9/30; H01F 1/00
(52) U.S. Cl. ..... 218/146; 335/216
(58) Field of Search ..... 218/146, 123, 218/124, 125, 126, 127, 128; 335/216, 299; 505/1; 174/125.1

(56) References Cited

U.S. PATENT DOCUMENTS 3,557,331 * 1/1971 Golata ..... 218/146
4,542,266 * 9/1985 Haessler et al. ..... 218/22

FOREIGN PATENT DOCUMENTS 56-16932 4/1981 (JP) .
2201836 8/1990 (JP) .

* cited by examiner

*Primary Examiner*—Lincoln Donovan
(74) *Attorney, Agent, or Firm*—Leydig, Voit & Mayer, Ltd.

(57) ABSTRACT

The invention provides a persistent current circuit switch of high performance having a small contact resistance. The persistent current circuit switch has a pair of oppositely arranged electrodes and ends of the electrodes are brought into line contact or dot contact with each other. A bore is located at the center of the end of one of the electrodes to reduce the rigidity of the electrode end so that the electrodes can be brought smoothly into contact with each other.

18 Claims, 9 Drawing Sheets

CONTACT TRACE OF CONTACT

CONTACT TRACE OF CONTACT

PERSISTENT CURRENT CIRCUIT SWITCH

BACKGROUND OF THE INVENTION

1. Field of the Invention

The present invention relates to a persistent current circuit switch used to operate a super conductive coil by a permanent electric current, and more particularly to a persistent current circuit switch in which a pair of electrodes are oppositely arranged so as to contact and separate from each other. Contacts of the electrodes are brought into line contact or dot series contact with each other.

2. Description of the Related Art

In a persistent current circuit switch that short-circuits both ends of a super conductive coil, it is required that contact resistance value in a turning-on (closed) state of the persistent current circuit switch be very small. A clean contact surface can be obtained in a persistent current circuit switch of vacuum type having electrodes arranged in a vacuum since impurities, an oxide film, etc. are not attached to the contact surface.

For example, a persistent current circuit switch disclosed in Japanese Examined Patent Application No. Sho 56-16932 is conventionally known as the persistent current circuit switch of vacuum type. FIG. 17 shows this persistent current circuit switch. FIG. 18 is a cross-sectional view of a portion taken along the broken line 18—18 shown in FIG. 17.

In FIG. 17, reference numerals 1, 2 and 3 respectively denote a movable electrode, a super conductive metallic member on the side of the movable electrode, and a superconductive metallic member on the side of a fixed electrode. Reference numerals 4, 5 and 6 respectively denote the fixed electrode, a metallic cover on the fixture side, and a movable electrode joining member. Reference numerals 7, 8 and 9 respectively denote bellows, a metallic cover on the movable side, and a metallic sleeve on the movable side. Reference numerals 10 and 11 respectively denote an insulating sleeve and a metallic sleeve on the fixture side.

FIG. 19 is a view showing characteristics of a contact of this conventional persistent current circuit switch. FIG. 20 is a view showing contact traces of the contact of the conventional persistent current circuit switch.

An operation of this switch will next be explained.

In FIGS. 17 and 18, each of the movable electrode 1 and the fixed electrode 4 is constructed by, for example, a fine metallic material such as copper and silver. Superconductive metallic members 2, 3 each constructed by, for example, an Nb-Ti alloy having a columnar shape are respectively buried in central portions of the movable electrode 1 and the fixed electrode 4 along a flow direction of an electric current. Closing and opening operations of the movable electrode 1 are performed by a not-shown driving mechanism. When the persistent current circuit switch is turned on (closed), the movable electrode 1 and the fixed electrode 4 are closed so that the superconductive metallic members 2 and 3 are brought into contact with each other and a superconductive contact is formed.

Reference numeral 7 in FIG. 17 denotes bellows. One end of the bellows 7 is airtightly and fixedly attached to the movable electrode 1 via the movable electrode joining member 6. The other end of the bellows 7 is airtightly and fixedly attached to the insulating sleeve 10 made of a ceramic through the movable side metallic cover 8 and the movable side metallic sleeve 9. On the other hand, another bellows on the fixed electrode 4 side is also airtightly and fixedly attached to the insulating sleeve 10 through the fixing side metallic cover 5 and the fixing side metallic sleeve 11. The air in the interior of an airtight container is removed to form a vacuum.

It is necessary to place the persistent current circuit switch under a very low temperature state to maintain each of the superconductive metallic members 2, 3 in a superconductive state. Accordingly, the persistent current circuit switch is cooled by not-shown liquid helium, a refrigerator, etc.

FIG. 19 shows characteristics of a flowing electric current and a contact resistance value between the electrodes at a closing time in the persistent current circuit switch in which the superconductive metallic member 2 is 20 mm in diameter and a planned flowing electric current value is set to I=1000 [A] in the above conventional structure.

According to the drawing, when the flowing electric current I is gradually increased from 0 [A] at the closing time of the switch, the contact resistance value R is maintained in a super low resistance state of $2\times10^{-9}$ [Ω] since the switch is in the superconductive state. However, the superconductive contact is suddenly quenched (the superconductive state is broken) near I=300 [A], and the contact resistance value changes to a state of $R=2\times10^{-5}$ [Ω].

FIG. 20 shows a contacting situation of contacts of the superconductive metallic member 2 on the side of the movable electrode 1 and the superconductive metallic member 3 on the side of the fixed electrode 4 after the closing and opening operations are performed about ten times in the above conventional structure. Reference numeral 15*a* denotes contact traces left on a surface of the superconductive metallic member 3 on the side of the fixed electrode 4. These traces should be wide traces left along the entire circumference of the superconductive metallic member 3 when the superconductive metallic members 2 and 3 are ideally brought into contact with each other.

In the conventional persistent current circuit switch, as mentioned above, though a very small contact resistance value is obtained when the electric current value is low, a contact face is quenched when the electric current value is higher than the planned electric current value. Therefore, when the persistent current circuit switch is actually used, a problem exists in that three persistent current circuit switches or more are connected in parallel to each other and as large a persistent current circuit switch as one having a planned flowing electric current value I=3000 [A] is used, etc. so that a device is complicated and large-sized.

SUMMARY OF THE INVENTION

The present invention has been made to solve the above-mentioned problems, and therefore, has an object of the present invention to provide a persistent current circuit switch of high performance in which a contact resistance value in a closing state of the switch is small.

To attain the above-mentioned object, the present invention has the following structures.

According to a first aspect of the present invention, a persistent current circuit switch in which a pair of electrodes are oppositely arranged so as to contact/separate from each other, and one end of the electrodes is engaged to the other end thereof so that contacts of the electrodes are brought into line contact or dot series contact with each other, a bored portion is formed at the center of the end of at least one of the electrodes to reduce the rigidity of the end of electrode so that the contacts are smoothly brought into contact with each other.

According to a second aspect of the present invention, in the first aspect of the present invention, a persistent current circuit switch has the end of the one electrode in a hemispherical convex shape and the end of the other electrode is formed in an inverse conical or a hemispherical concave shape.

According to a third aspect of the present invention, in the first aspect of the present invention, a persistent current circuit switch has the end of the one electrode in a conical convex shape and the end of the other electrode is formed in a hemispherical concave shape.

According to a fourth aspect of the present invention, in the first aspect of the present invention, a persistent current circuit switch has as the bored portion a hole having a U-shape in section.

According to a fifth aspect of the present invention, in the first aspect of the present invention, a persistent current circuit switch has a notch portion formed in an outer circumference of the end of at leas one of the pair of electrodes.

According to a sixth aspect of the present invention, a persistent current circuit switch in which a pair of electrodes are oppositely arranged so as to contact/separate from each other, and one end of the electrodes is engaged to the other end thereof so that contacts of the electrodes are brought into line contact or dot series contact with each other in a ring shape, has a bored portion formed in a contacting/separating direction of the electrodes at the center of the ring shape of at least one of electrodes.

According to a seventh aspect of the present invention, in the sixth aspect of the present invention, a persistent current circuit switch has the end of the one electrode formed in a hemispherical convex shape and the end of the other electrode is formed in an inverse conical or hemispherical concave shape.

According to an eighth aspect of the present invention, in the sixth aspect of the present invention, a persistent current circuit switch has the end of the one electrode formed in a conical convex shape and the end of the other electrode is formed in a hemispherical concave shape.

According to a ninth aspect of the present invention, in the sixth aspect of the present invention, a persistent current circuit switch has the bored portion a hole having a U-shape in section.

According to a tenth aspect of the present invention, in the sixth aspect of the present invention, a persistent current circuit switch has a notch portion formed in an outer circumference of the end of at least one of the pair of electrodes.

According to an eleventh aspect of the present invention, a persistent current circuit switch in which a pair of rectangular parallelepiped electrodes are oppositely arranged so as to contact/separate from each other, and an end face of one of the electrodes is engaged to an end face of the other so that contacts of the electrodes are brought into line contact or dot series contact with each other in a straight line shape, has a bored portion formed in a contacting/separating direction in a central longitudinal direction of the end face of at least one of the electrodes.

According to a twelfth aspect of the present invention, in the eleventh aspect of the present invention, a persistent current circuit switch has the end face of the one electrode formed in a semicylindrical convex shape and the end face of the other electrode is formed in a groove concave shape of a V-shape in section.

According to a thirteenth aspect of the present invention, in the eleventh aspect of the present invention, a persistent current circuit switch has as the bored portion a groove having a U-shape in section.

According to a fourteenth aspect of the present invention, in the eleventh aspect of the present invention, a persistent current circuit switch has notch portions formed on two side faces brought into contact with long sides of a contacting/separating end face of at least one of the pair of electrodes, the notch portion being in parallel to the long sides.

DETAILED DESCRIPTION OF THE PREFERRED EMBODIMENTS

Embodiment 1

In a persistent current circuit switch in Embodiment 1, a pair of electrodes are oppositely arranged so as to contact/separate from each other and an end of one of the electrodes is engaged to an end of the other so that contacts of the electrodes are brought into line contact with each other in a ring shape. In this persistent current circuit switch, a bore is formed at the center of an end of a movable electrode to reduce rigidity in the end of the movable electrode so that the contacts smoothly contact with each other. Namely, the persistent current circuit switch in Embodiment 1 is constructed such that, at closing of the persistent current circuit switch, contact portions slide along a receiving shape of a fixed electrode on the counterpart side to make the contacts fit well to each other.

Figure 1:
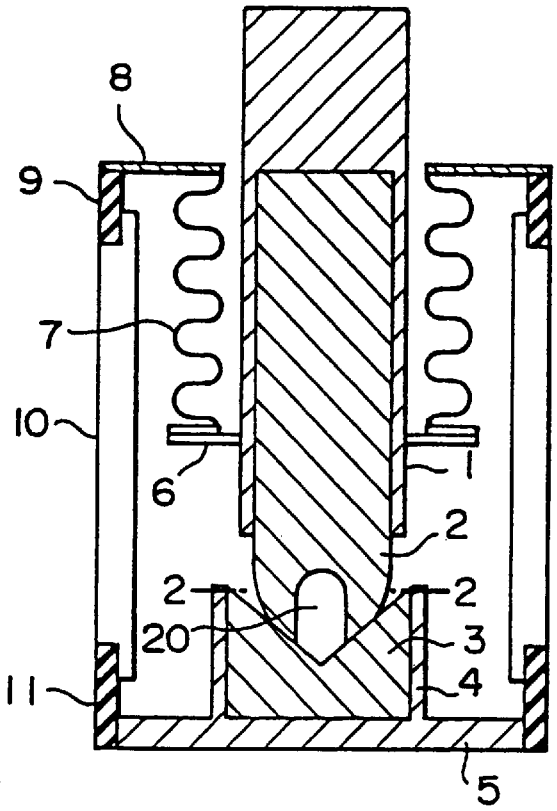
FIG. 1 is a vertical sectional view showing the structure of Embodiment 1.
Figure 2:
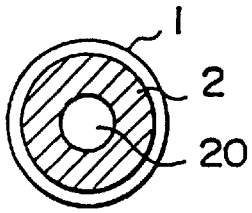
FIG. 2 is a horizontal sectional view of a portion taken along the broken line 2—2 of FIG. 1.
Figure 17:
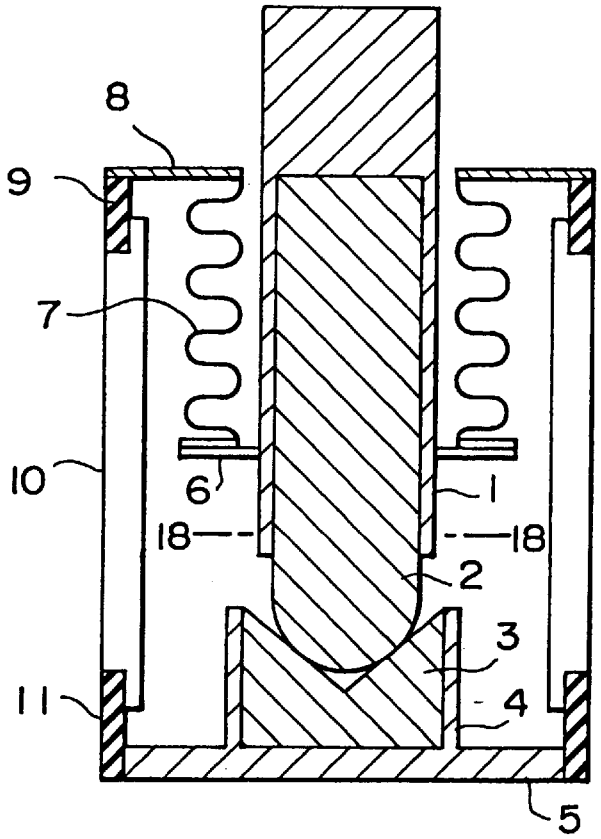
FIG. 17 PRIOR ART
FIG. 17 is a view showing the structure of a conventional persistent current circuit switch.
Figure 18:
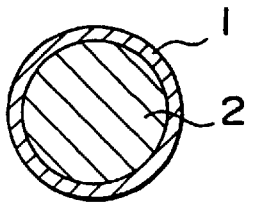
FIG. 18 PRIOR ART
FIG. 18 is a horizontal sectional view of a portion taken along the broken line 18—18 of FIG. 17.
Figure 19:
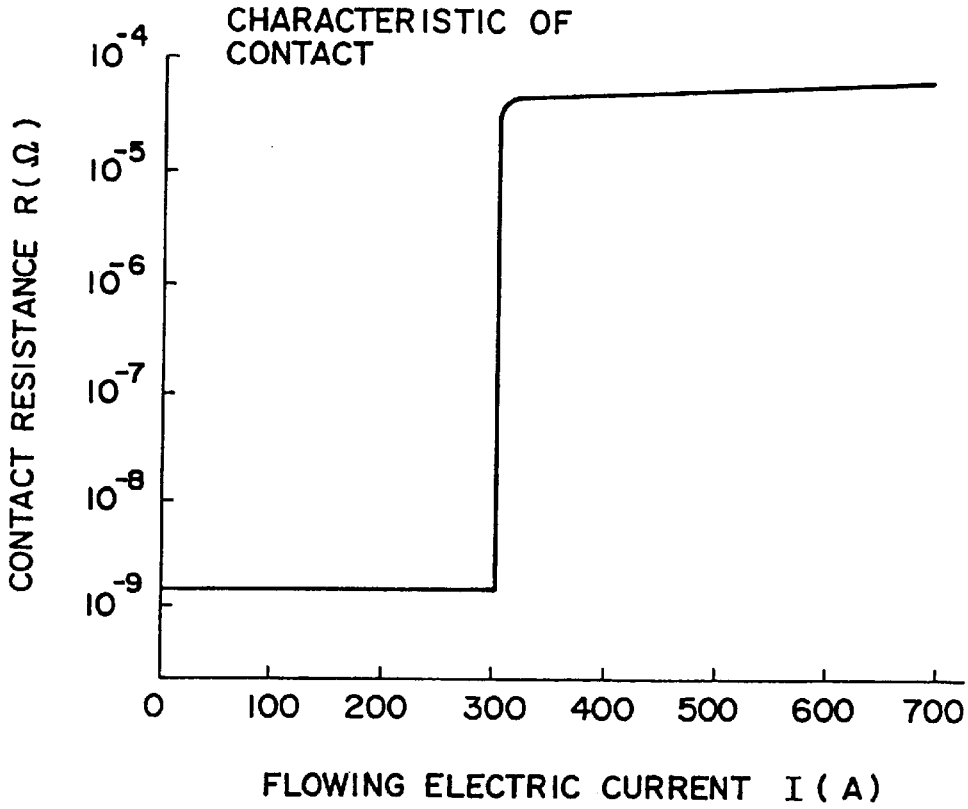
FIG. 19 PRIOR ART
FIG. 19 is a graph showing characteristics of a contact of the conventional persistent current circuit switch.
Figure 20:
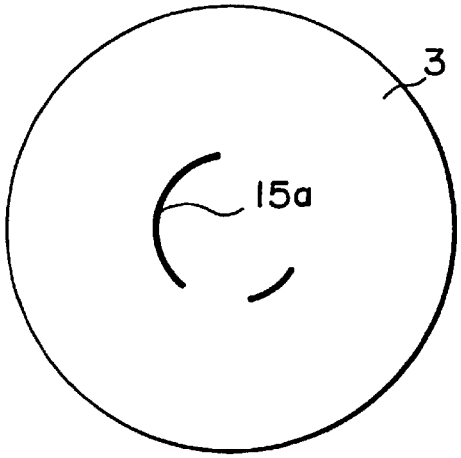
FIG 20 PRIOR ART
FIG. 20 is a view showing contact traces of the contact of the conventional persistent current circuit switch.

This structure will next be explained on the basis of FIGS. 1 to 4. FIG. 1 is a vertical sectional view of a main portion of the persistent current circuit switch, showing the structure of Embodiment 1. FIG. 2 is a horizontal sectional view of a portion taken along the broken line 2—2 of FIG. 1. Parts having a structure same as or equivalent to the structure in conventional persistent current circuit switch shown in FIG. 17 are denoted by the same reference numerals and their explanations are omitted here.

In FIGS. 1 and 2, reference numeral 1 denotes a movable electrode formed in a columnar shape. A superconductive metallic member 2 is arranged as a contact portion on the side of this columnar movable electrode 1. An end of the superconductive metallic member 2 is formed in a hemispherical convex shape. Reference numeral 4 denotes a fixed electrode similarly formed in a columnar shape. This columnar fixed electrode 4 has a diameter slightly greater than that of the above movable electrode 1. A superconductive metallic member 3 is arranged at an end of the fixed electrode 4 as a contact portion on the side of the fixed electrode 1. The superconductive metallic member 3 is formed in an inverse-conical concave shape.

The above structure of the movable electrode 1 and the fixed electrode 4 is similar to those of the conventional persistent current circuit switch. The columnar superconductive metallic members 2, 3 each formed of, for example, an Nb—Ti alloy are respectively arranged on contact sides of the movable electrode 1 and the fixed electrode 4. This switching portion is airtightly constructed by another material, etc. The persistent current circuit switch is cooled by liquid helium, a refrigerator, etc. Closing and opening operations of the switch are performed by a not-shown driving mechanism. The superconductive metallic members 2 and 3 are brought into contact with each other by closing the movable electrode 1 and the fixed electrode 4 so that a superconductive contact is formed. All these structures above are also similar to those of the conventional persistent current circuit switch.

In this Embodiment 1, in the above structure, a bore 20 is formed in an end of the contact side of the superconductive metallic member 2 on the side of the movable electrode 1, i.e., in a central portion of an end of the movable electrode 1. The bore 20 is bored in a direction in which the electrodes contact/separate from each other. This bore 20 in this example is a hole having a U-shape in section. This hole has a diameter smaller than the diameter of a ring shape to be formed at subsequent line contact, and is arranged in a position located on the same axis as this ring shape.

When the bore 20 is thus formed at the end of the movable electrode 1, at the end of the superconductive metallic member 2 in this example, rigidity of the movable electrode 1 on its end side is reduced. When the movable electrode 1 is engaged to the superconductive metallic member 3 along the inverse-conical concave shape of this metallic member 3 on the side of the fixed electrode 4 at a closing time of the switch, the contact portions smoothly slide to have the contacts fit well to each other. Thus, the bore 20 reduces the rigidity of the movable electrode 1 at its end and makes the contacts smoothly contact with each other. Accordingly, as long as the hole has a structure having such a function, this bore 20 may be formed in any shape. For example, the bore 20 may have a U-shape, a V-shape or a semicircular shape in section.

Figure 3:
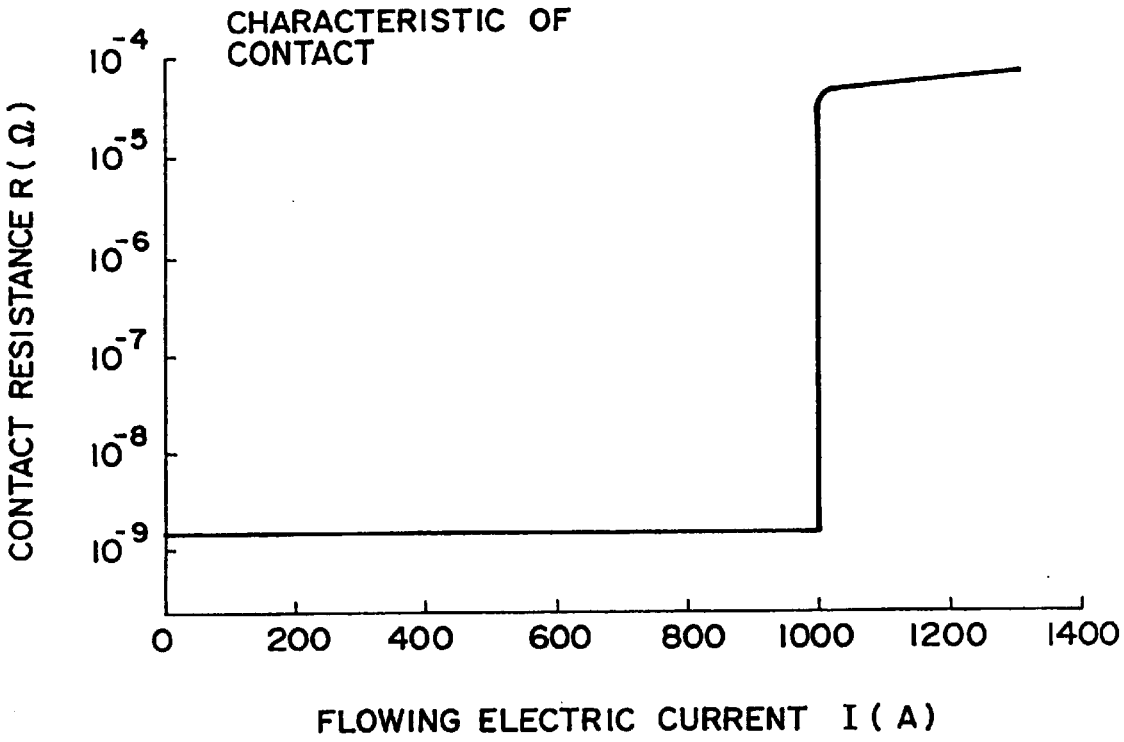
FIG. 3 is a graph showing characteristics of a contact of the present invention.

FIG. 3 shows characteristics of a flowing electric current and a contact resistance value between the electrodes at closing of the persistent current circuit switch in which the superconductive metallic member 2 has a diameter of 20 mm and a planned flowing electric current value is set to I=1000 [A] in the above Embodiment 1.

When the flowing electric current I is gradually increased from 0 [A] at the closing time of the switch, the contact resistance value R is maintained in a super low resistance state of $2\times10^{-9}$ [Ω] since the switch is in superconductive state. However, the contact resistance value R is transferred to a state of $R=2\times10^{-5}$ [Ω] near the planned flowing electric current I=1000 [A].

Figure 4:
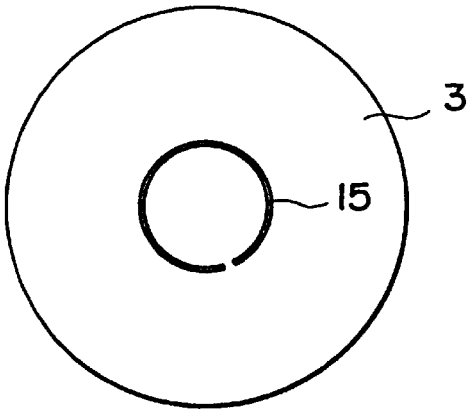
FIG. 4 is a view showing contact traces of the contact of the present invention.

FIG. 4 shows a contacting situation of the superconductive metallic member 2 on the side of the movable electrode 1 and the superconductive metallic member 3 on the side of the fixed electrode 4 after the closing and opening operations are performed about ten times in this Embodiment 1. As denoted by reference numeral 15*b* in this figure, contact traces left on a surface of the superconductive metallic member 3 on the side of the fixed electrode 4 clearly appear in the entire circumference of the contact of a ring shape line. Further, this line is wide so that ideal contact is realized.

Embodiment 2

Embodiment 2 differs from the above embodiment 1 only in that an end of the contact side of the superconductive metallic member 3 on the side of the fixed electrode 4 is formed in a hemispherical concave shape. The rest of the structures is similar to those of the above first embodiment 1. In this case, the rest of the structures includes that a bored portion 20 is formed at an end of the contact side of the superconductive metallic member 2 on the side of the movable electrode 1, i.e., at an end of a hemispherical convex shape, and is a hole having a U-shape in section.

Figure 5:
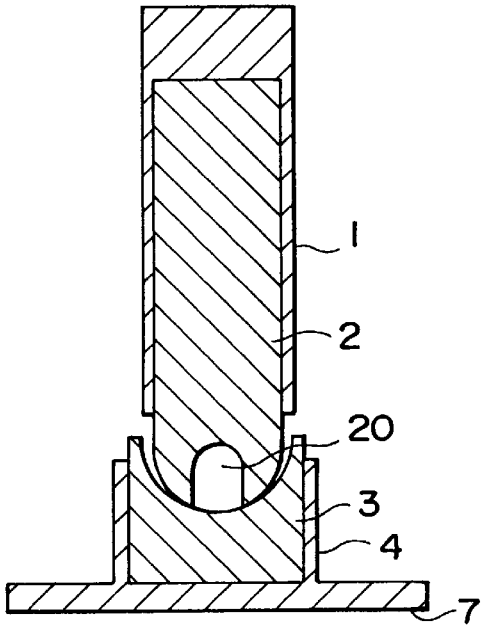
FIG. 5 is a vertical sectional view showing the structure of Embodiment 2.

In FIG. 5, a diameter of the hemispherical concave shape formed at the end of the fixed electrode 4 shown in this Embodiment 2 is slightly greater than that of the hemispherical convex shape of the movable electrode 1. Further, this hemispherical concave shape is formed in a so-called bowl shape in which the diameter of an opening portion of the hemispherical concave shape is further enlargedly increased. Thus, the curved surfaces having different curvatures of the same direction are brought into contact with each other in section in contacting/separating direction of the electrodes. The rest of the structures is similar to those of the first Embodiment 1 and their explanations are therefore omitted.

A curved surface that is unequal but corresponds to the hemispherical surface of the hemispherical convex shape of the movable electrode 1 is thus formed at the end of the fixed electrode 4. Accordingly, when seen in section the contacting/separating direction, the curved surfaces of the same direction, though different in their curvatures, are brought into contact with each other. Therefore, a line width of this line contact is increased in comparison with the line width of line contact formed by a curved surface (a hemispherical surface of the movable electrode 1) in the above Embodiment 1 and a plane (a slanting face of the fixed electrode 4) coming in contact with this curved surface in its tangential direction. Accordingly, a contact area in the line contact can be increased so that contact resistance can be reduced.

The other action and effects in this Embodiment 2 are similar to those in the above Embodiment 1.

Embodiment 3

Embodiment 3 differs from the above Embodiment 2 only in that an end of the contact side of the superconductive metallic member 2 on the side of the movable electrode 1 is formed in a conical convex shape. The rest of the structures is similar to those in the above second embodiment. In this case, the rest of the structures includes that a bored portion 20 is formed on the contact side of the superconductive metallic member 2 on the side of the movable electrode 1, i.e., at an end of the conical convex shape and is a hole having a U-shape in section.

Figure 6:
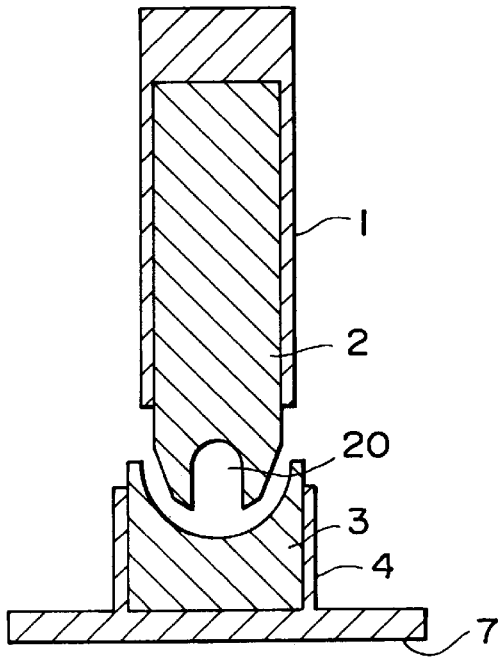
FIG. 6 is a vertical sectional view showing the structure of Embodiment 3.

In FIG. 6, an end of the fixed electrode 4 is formed in a hemispherical concave shape. Namely, this end of the fixed electrode 4 is a curved surface formed in a concave shape. In contrast to this, the end of the contact side of the superconductive metallic member 2 on the side of the movable electrode 1 shown in this Embodiment 3 is of a convex conical shape. When the electrodes are seen in section in the contacting/separating directions, a slanting flat face is brought into contact with a receiving concave curved surface. Therefore, contacts are formed at both upper and lower ends of the superconductive metallic member with respect to the slanting flat face. Namely, the double line contacts in ring shape are realized.

When such a structure is used, a line length in the line contact can be doubly increased so that contact resistance can be reduced.

The other action and effects in this Embodiment 2 are similar to those in the above first embodiment.

Embodiment 4

Figure 7:
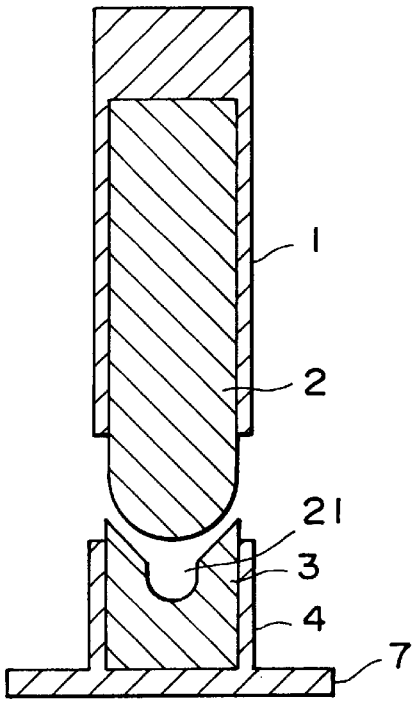
FIG. 7 is a vertical sectional view showing the structure of Embodiment 4.

In Embodiment 4, the structure described in the above Embodiment 1 is modified such that a bored hole is formed at an end of a contact side of the superconductive metallic member 3 of the fixed electrode 4, not at the side of the movable electrode 1 in the above. Accordingly, as shown in FIG. 7, an end of the contact side of the superconductive metallic member 2 of the movable electrode 1 is formed in a hemispherical convex shape having no hole. The end of the contact side of the superconductive metallic member 3 of the fixed electrode 4 is formed in an inverse-conical concave shape.

In this Embodiment 4, a bored portion 21 is formed in contacting/separating directions of the electrodes at the bottom of the inverse-conical concave shape of the fixed electrode 4, i.e., in a central portion of the end of the fixed electrode 4. In this example, this bored portion 21 is a hole having a U-shape in section. A diameter of this hole is smaller than the diameter of a ring shape to be formed at subsequent line contact. This hole is arranged in a position located on the same axis as this ring shape.

When the bored portion 21 is thus formed at the end of the fixed electrode 4, namely, at the end of the superconductive metallic member 3 in this example, rigidity of the hemispherical concave shape, i.e., the fixed electrode 4 on its end side is reduced. Accordingly, at a closing time of the switch, contact portions are smoothly slid when the movable electrode 1 is engaged to the fixed electrode 4 along its hemispherical concave shape. Therefore, contacts of the electrodes are well fit to each other. Thus, the bored portion 21 reduces the rigidity of the fixed electrode 4 on its end side and smoothes the mutual contact of the contacts. Accordingly, similar to the case of the above Embodiment 1, as long as the bored portion 21 has a structure having such a function, the hole of the bored portion 21 may be formed in any shape.

Embodiment 5

In the above Embodiments 1 to 4, the bored portion is formed in one of the pair of electrodes. In contrast to this, Embodiment 5 employs such a structure that, in the persistent current circuit switch in which a pair of electrodes oppositely arranged so as to contact/separate from each other, and one end thereof is engaged to the other end thereof so that contacts of the electrodes are brought into line contact in a ring shape, the bored portion is formed at the center of the ring shape of each of both the electrodes in contacting/separating directions of the electrodes. The rest of the structures is similar to those in the above Embodiments 1 to 4.

Figure 8:
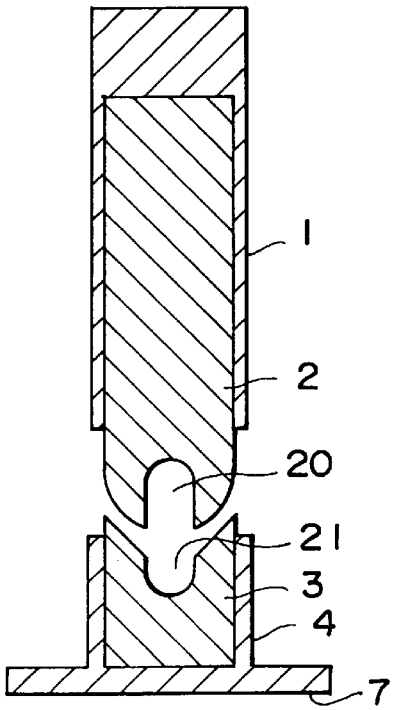
FIG. 8 is a vertical sectional view showing the structure of Embodiment 5.

In FIG. 8, in this Embodiment 5, an end of the movable electrode 1 is formed in a hemispherical convex shape similar to that on the side of the movable electrode 1 shown in the above Embodiments 1 and 2. An end of the other, fixed electrode 4, is formed in an inverse-conical concave shape similar to that on the fixed electrode 4 side shown in the above Embodiment 4.

In such a structure, rigidity of each of the pair of electrodes on their end sides is further reduced. Therefore, at a closing time of the switch, both contact portions are smoothly slid when the movable electrode 1 having the hemispherical convex shape is engaged to the fixed electrode 4 along its concave shape. Accordingly, contacts are further well engaged to each other. Thus, in the example shown in the drawing, both the electrodes, i.e., the superconductive metallic members 2, 3 of the electrodes come in, not thin, but wide line contact with each other so that a wider contact face is obtained.

Embodiment 6

In Embodiment 6, an arranging method of the superconductive metallic member 2 in the movable electrode 1 and an arranging method of the superconductive metallic member 3 in the fixed electrode 4 are different from those in the above Embodiment 5.

In this Embodiment 6, the superconductive metallic members 2, 3 are coaxially buried in a cylindrical shape in a pair of columnar electrodes 1, 4, respectively. End faces of the cylindrical superconductive metallic members are brought into contact with each other in an electric current flowing direction at a closing time of the switch so that the line contact of a ring shape is formed.

Figure 9:
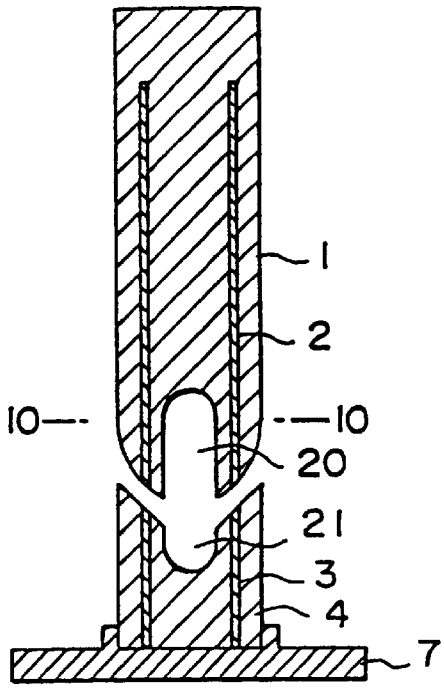
FIG. 9 is a vertical sectional view showing the structure of Embodiment 6.
Figure 10:
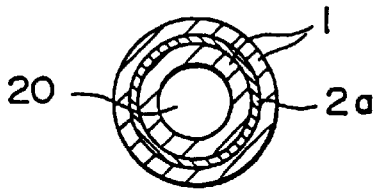
FIG. 10 is a horizontal sectional view of a portion taken along the broken line 10—10 of FIG. 9.

In FIG. 9, reference numeral 2 denotes the thin cylindrical superconductive metallic member buried on the side of the movable electrode 1. Reference numeral 3 denotes the thin cylindrical superconductive metallic member buried on the side of the fixed electrode 4. In FIG. 10, reference numeral 2*a* denotes a superconductive metallic member 2 formed in a ring shape in the cross-sectional view taken along the broken line 8—8 of FIG. 9.

Also in such a structure in which the cylindrical superconductive metallic members 2, 3 are respectively buried in the electrodes 1, 4, bored portions 20, 21 are respectively formed at ends of the electrodes 1, 4 on the inner side of a contact portion formed in the ring shape in contacting/separating directions of the electrodes.

In this Embodiment 6, the bored portions 20, 21 are respectively formed in the electrodes 1, 4. However, the bored portion may be formed in only one of the electrodes 1, 4. Further, the bored portion 20 or 21 may be formed in any shape as long as the bored portion has a function similar to that explained in the above Embodiments 1 to 5.

When the bored portions are formed in both the electrodes, action and effects similar to those in the above Embodiment 5 are obtained. When the bored portion is formed in one of the electrodes, similar action and effects to those in the above corresponding Embodiments are obtained.

Embodiment 7

Figure 11:
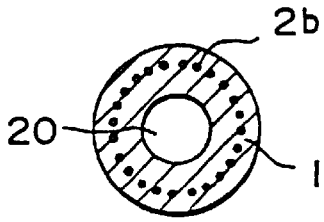
FIG. 11 is a vertical sectional view showing the structure of Embodiment 7.

In Embodiment 7, as shown in FIG. 11, many linear superconductive metallic members 2*a* are spaced from each other and are buried in a cylindrical form instead of the cylindrical superconductive metallic members 2, 3 in the above Embodiment 6.

Contacts in such a structure are not bring into line contact with each other in a ring shape as explained in the above Embodiments 1 to 6, but form a ring shape that is an annular dot series consisting of many dots formed of the end faces of many linear superconductive metallic members 2, 3, which are exposed at ends of the electrodes.

Here, as mentioned above, "dot series contact" in this specification means contact forming the contacts in a relation in which each dot constituting the dot series on one electrode side corresponds to each dot constituting the dot series of the other electrode.

Thus, also in the structure in which the linear superconductive metallic members 2, 3 are respectively buried in a cylindrical shape in the electrodes 1, 4, bored portions 20, 21 are respectively formed at ends of the electrodes 1, 4 on the inner side of the contact portion formed in the ring shape in contacting/separating direction of the electrodes. When vertically cut, the linear superconductive metallic member 2*a* buried in a cylindrical shape presents itself as a shape similar to that shown in FIG. 9. The structure, action and effects of the superconductive metallic members are similar to those in the explanation in the above Embodiment 6.

Embodiment 8

Embodiment 8 employs the structure shown in the above Embodiment 7 with such a modification that a notch portion for reducing rigidity of each of ends of both the movable electrode 1 and the fixed electrode 4 is formed on the outer circumferential side of each of these electrode ends.

Figure 12:
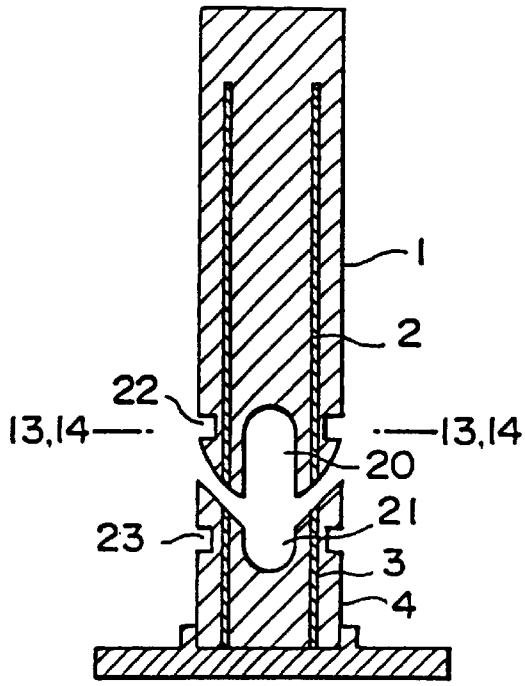
FIG. 12 is a vertical sectional view showing the structure of Embodiment 8.
Figure 13:
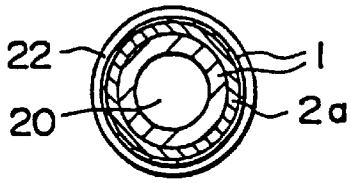
FIG. 13 is a horizontal sectional view of a portion taken along the broken line 13—13 of FIG. 12.

FIGS. 12 and 13 show a structure example in which cylindrical superconductive metallic members 2, 3 having contacts forming line contact in a ring shape are respectively buried in the electrodes 1, 4. In these FIGS., reference numeral 22 denotes the notch portion formed in the outer circumference of the movable electrode 1 near its contact side end. Reference numeral 23 denotes the notch portion formed in the outer circumference of the fixed electrode 4 near its contact side end. Each of the notch portions 22, 23 is formed in a groove having a U-shape in section, but is not limited to this groove shape. For example, each of the notch portions may be also formed in a U-shape, a V-shape or a semicircular shape in section.

In the above Embodiment 8, the notch portions 22, 23 are respectively formed in the outer circumferences of the electrodes 1, 4 in the structure in which the bored portions 20, 21 are formed on sides of the electrodes 1, 4. However, one of the notch portions 22, 23 may be formed on only one electrode side.

Further, the notch portions are not limited to the ones shown in the above Embodiment 8, but may be also formed in the outer circumferences of the electrode sides on which the bored portions 20, 21 in the above Embodiments 1 to 5 are formed.

In either case, when these notch portions 22, 23 are formed in the outer circumferences, rigidity of each of the ends of the electrodes can be further reduced by synergistic effects of the notch portions 22, 23 and the bored portions 20, 21 formed on interior sides of the electrodes.

Accordingly, with such a structure, a contact portion, at a closing time of the switch, is smoothly slid at the end of at least one of the electrodes 1, 4 when the movable electrode having the hemispherical convex shape is engaged to the fixed electrode along the concave shape. Accordingly, the contacts further fit well to each other so that preferable contact at both the electrodes 1, 4 is obtained.

Embodiment 9

Figure 14:
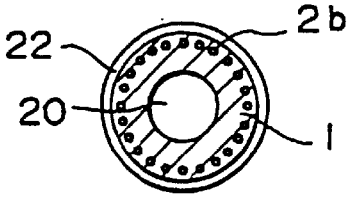
FIG. 14 is a horizontal sectional view of a portion taken along the broken line 14—14 of FIG. 12 and showing the structure of Embodiment 9.

In Embodiment 9, many linear superconductive metallic members 2*b*, 3*b* having contacts coming in dot series contact with each other in a ring shape are respectively buried in a cylindrical shape in the electrodes 1, 4, instead of the cylindrical superconductive metallic members 2, 3 having contacts coming in line contact with each other in the ring shape in the above Embodiment 8. FIG. 14 shows a cross-sectional view taken along the broken line 13—13 in FIG. 12 showing Embodiment 8. Reference numeral 22 in FIG. 14 denotes a notch portion.

The rest of the structures, action and effects in this Embodiment 9 is similar to those explained in the above Embodiment 8.

Embodiment 10

In Embodiment 10, a bored portion is formed in a central longitudinal direction of a movable electrode on its end face in a persistent current circuit switch in which an end face of one of a pair of electrodes having a rectangular parallelepiped shape and oppositely arranged so as to contact/separate from each other, and one end thereof is engaged to the other end thereof so that contacts of the electrodes are brought into line contact with each other. Rigidity of the end of this movable electrode is reduced by the bored portion so that the contacts smoothly contact with each other. Namely, the contact portion is slid along a receiving shape of the fixed electrode on the counterpart side and the contacts are well engaged to each other at a closing time of the persistent current circuit switch.

Figure 15:
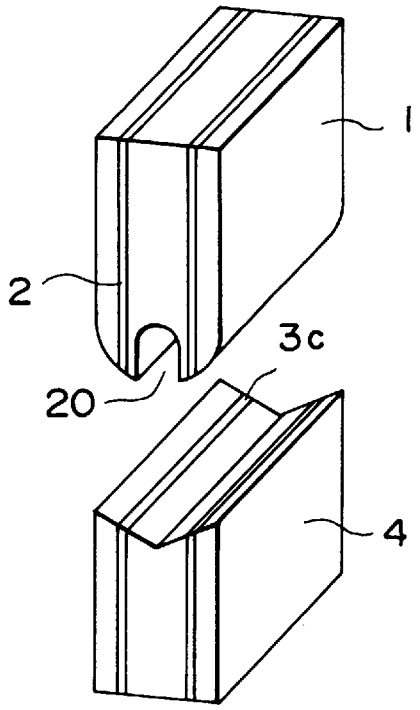
FIG. 15 is a perspective view showing the structure of Embodiment 10.
Figure 16:
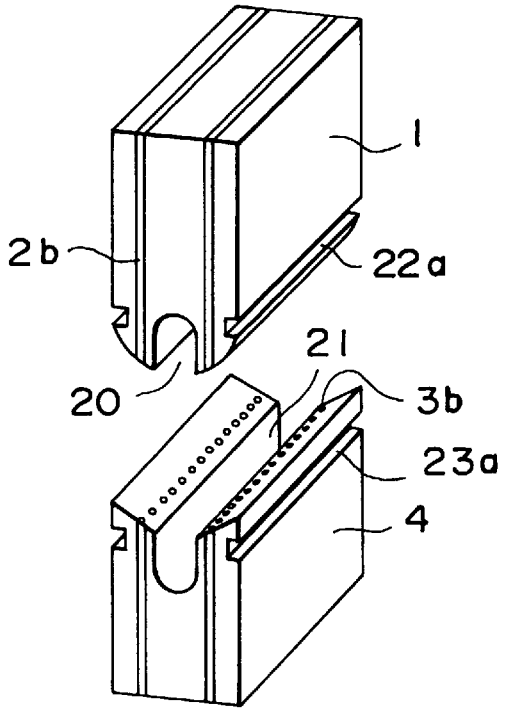
FIG. 16 is a perspective view showing the structure of Embodiment 11.

This structure will next be explained on the basis of FIG. 15. FIG. 15 is a perspective view of a main portion of a switch constructing portion.

In this FIG., reference numeral 1 denotes a movable electrode formed in a plate shape as one example of the rectangular parallelepiped shape. An end face of this plate-shaped movable electrode 1 on its end side, i.e., an end face of the movable electrode 1 is formed in a semicylindrical convex shape having a semicylindrical curved surface.

A superconductive metallic member on the side of the movable electrode 1 as a contact portion is arranged as two plate-shaped members 2*c*, 2*c*. The plated-shaped members 2*c*, 2*c* are spaced from each other and are buried in parallel with each other on both sides of a ridge of the semicylindrical convex shape of the movable electrode 1 with this ridge as the center. Namely, end faces of the superconductive metallic member as the two plate-shaped members 2*c*, 2*c* constituting the contact portion on the side of this movable electrode 1 are shown as two parallel straight lines on the semicylindrical curved surfaces on both the sides of the ridge of the above semicylindrical convex shape with this ridge as the center.

On the other hand, reference numeral 4 in the FIG. denotes a fixed electrode similarly formed in a plate shape as one example of the rectangular parallelepiped shape. In this example, the fixed electrode 4 is set to have a plate thickness slightly thicker than that of the above movable electrode 1. A groove concave shape having a V-shape in section and having a depth in contacting/separating directions of the electrodes is formed on an end face, i.e., an end face of this plate-shaped fixed electrode 4 on its end side to receive the semicylindrical convex shape of the above movable electrode 1 on its end side. This groove concave shape is formed in a longitudinal direction on the end face of the fixed electrode 4.

A superconductive metallic member on the side of the fixed electrode 4 constituting a contact portion on the side of the fixed electrode 4 is also comprised of two plate-shaped members 3*c*, 3*c*. The plate-shaped members 3*c*, 3*c* are buried such that end faces of the superconductive metallic members 3*c*, 3*c* appear as two parallel straight lines on intermediate slanting faces on both sides of the tangent line at the bottom of V-shaped valley with this tangent line at the bottom of V-shaped valley as the center.

In the pair of electrodes 1, 4 as constructed above, a bored portion 20 having a depth in the contacting/separating directions of the electrodes is bored in a central longitudinal direction of the movable electrode 1 on its end face on the end side of the movable electrode 1. The bored portion 20 is formed in the longitudinal direction at the center of two parallel line contact lines straightly extending as a contact portion. A sectional shape of this bored portion 20 is a U-shape in FIG. 15, but is not limited to this U-shape as described in the description of the bored portion in the above Embodiment 1.

Thus, when the bored portion 20 extending in the longitudinal direction is formed at the center of the semicylindrical convex shape of the plate-shaped movable electrode 1 on its end face, rigidity of the movable electrode 1 on its end side, i.e., in a plate thickness direction on the end face side is reduced. Accordingly, the contact portion is smoothly slid at a closing time of the switch when the movable electrode 1 is engaged to the fixed electrode 4 along the groove concave shape on the side of the fixed electrode 4, i.e., along the slanting face in this example. Therefore, the contacts are well engaged to each other. Thus, the bored portion 20 reduces the rigidity of the movable electrode at its end and makes the contacts smoothly contact with each other. Accordingly, as long as the groove concave shape has a structure having such a function, the groove concave shape may take any sectional shape. For example, the groove concave shape may be a U-shape, a V-shape and a semicircular shape in section.

In this Embodiment 10, the bored portion 20 is formed on the end face of the movable electrode 1 as one of the pair of rectangular parallelepiped electrodes. However, a bored portion 21 may be formed on an end face of the other, fixed electrode 4. Further, the bored portions may be also respectively formed on the end faces of the electrodes 1, 4. When the bored portion is formed in each of the electrodes, rigidity on the electrode end side is further reduced and the contact portions of both the electrodes 1, 4 are further smoothly slid so that the contacts are further well fit to each other at the closing time of the switch for reasons similar to those in the explanation in Embodiment 1 in comparison with a case in which the bored portion 20 is formed in one of the electrodes.

Embodiment 11

In Embodiment 11, many linear superconductive metallic members 2*b*, 3*b* having contacts coming in dot series contact with each other in a straight line shape are respectively buried in the electrodes 1, 4 in a plate-shaped form, instead of the plate-shaped superconductive metallic members 2*c*, 3*c* having contacts coming in line contact with each other in a straight line shape in the structure shown in the above Embodiment 10. Further, a bored portion 21 is formed on the side of the fixed electrode 4 in addition to the side of the movable electrode 1. Further, notch portions 22*a*, 23*b* having functions corresponding to the notch portions 22, 23 shown in the above Embodiment 8 are respectively formed on both side face sides of the electrodes 1, 4 in parallel with the bored portions 20, 21.

The notch portions 22, 23 and 22*a*, 23*b* are all formed in a groove shape having a U-shape in section, but are not limited to this groove shape. For example, these notch portions may have a U-shape, a V-shape or a semicircular shape in section.

In this Embodiment 11, the notch portions 22*a*, 23*a* are respectively formed on both the side face sides of the electrodes 1, 4 in the structure in which the bored portions 20, 21 are formed on both the sides of the electrodes 1, 4. However, the notch portions 22*a*, 23*a* may be formed on both the side face sides of one of the electrodes.

In either case, since the notch portions 22*a*, 23*a* are formed, rigidity of the end of the electrode can be further reduced by synergistic actions of the notch portions 22*a*, 23*a* and the bored portions 20, 21 formed on the interior sides of the notch portions.

Particularly, when the switch is constructed as shown in Embodiment 11, at a closing time of the switch, the contact portions are further smoothly slid at the ends of both the electrodes 1, 4 when the movable electrode having the semisylindrical convex shape is engaged to the fixed electrode along the concave shape. Further, the contacts are even better engaged to each other. Accordingly, a preferable contact is obtained between the electrodes 1, 4.

In the explanation of the above Embodiments 1 to 4, the persistent current circuit switch is described as a persistent current circuit switch of vacuum type. However, the present invention can be applied to a persistent current circuit switch in which a gas having preferable insulating characteristics is sealed within an airtight container. The present invention can be also applied to a persistent current circuit switch in which a contact portion is directly operated within liquid helium without constructing the airtight container.

Further, an Nb—Ti alloy is explained as a material example of the superconductive metallic member. However, similar action and effects are obtained by utilizing a compound-including superconductive material of Nb3Sn, etc., a superconductive member including an oxide, etc.

In accordance with the present invention, the rigidity of an electrode at its contact side end having a bored portion is reduced. A contact portion is smoothly slid along the shape of an electrode on the counterpart side at a closing time of the persistent current circuit switch. Further, contacts are well engaged to each other. Thus, the superconductive metallic materials can be ideally brought into contact with each other so that an electric current flowing through the switch can be increased three times or more in comparison with the conventional case.

Accordingly, it is possible to provide a persistent current circuit switch of high performance in which contact resistance in the contacts is very small at any time and no switch is quenched until a planned electric current value.

In the structure where the bored portion is provided in each of the electrodes, the rigidity of the electrodes at their contact side ends is further reduced and the contact portions of the electrodes can be further smoothly slid at the closing time of the switch so that the contacts are further well engaged to each other, in comparison with a structure in which the bored portion is formed in one of the electrodes.

Further, in the structure in which a notch portion is formed on the outside of at least one of the electrodes, the rigidity of the electrode at its contact side end is further reduced in cooperation with an action of the bored portion, and the sliding of the contact portion and the mutual fit f the contacts can be further improved at the closing time of the switch.

What is claimed is:

1. A persistent current circuit switch comprising first and second electrodes contacting and separating from each other, an end of the first electrode contacting an end of the second electrode to close the switch, wherein the end of the second electrode is concave and receives the end of the first electrode for closing the switch and the end of the first electrode is convex and has a central recess extending only partially into the first electrode, reducing rigidity of the end of the first electrode so that an area of contact between the first and second electrodes when the first and second electrodes are brought into contact with each other is increased.

2. The persistent current circuit switch as claimed in claim 1, wherein the end of the first electrode has a hemispherical shape and the end of the second electrode has an inverse conical or hemispherical shape.

3. The persistent current circuit switch as claimed in claim 1, wherein the end of the first electrode has a conical shape and the end of the second electrode has a concave hemispherical shape.

4. The persistent current circuit switch as claimed in claim 1, wherein the recess has a U-shape in a cross-section taken parallel to a direction of relative movement of the first and second electrodes in contacting each other and separating from each other.

5. The persistent current circuit switch as claimed in claim 1, including a notch transverse to the recess in an outer surface of at least one of the first and second electrodes.

6. The persistent current circuit switch as claimed in claim 1, wherein the recess extends parallel to a direction of relatively movement of the first and second electrodes for contacting each other and separating from each other.

7. The persistent current circuit switch as claimed in claim 1, wherein the first and second electrodes have respective circular cross-sections transverse to the direction of relative movement of the first and second electrodes.

8. The persistent current circuit switch as claimed in claim 1, wherein the end of the second electrode includes a central recess extending parallel to the direction of relative movement of the first and second electrodes.

9. A persistent current circuit switch comprising first and second rectangular parallelepiped electrodes contacting and separating from each other, an end face of the first electrode contacting an end face of the second electrode within a region having a linear shape to close the switch, wherein the end face of the second electrode in concave and receives the end face of the first electrode for closing the switch and the first electrode has a central recess extending transverse to a direction of relative movement of the first and second electrodes in contacting each other and separating from each other, reducing rigidity of the end face of the first electrode so that an area of contact between the first and second electrodes when the first and second electrodes are brought into contact with each other is increased.

10. The persistent current circuit switch as claimed in claim 9, wherein the end face of the first electrode has a semicylindrical shape and the end face of the second electrode has a concave groove with a V-shape in a cross-section taken parallel to the direction of relative movement of the first and second electrodes.

11. The persistent current circuit switch as claimed in claim 9, wherein the recess has a U-shape in a cross-section taken parallel to the direction of relative movement of the first and second electrodes.

12. The persistent current circuit switch as claimed in claim 9, including notches in two side faces of at least one of the first and second electrodes, the notches being parallel and transverse to the direction of relative movement of the first and second electrodes.

13. The persistent current circuit switch as claimed in claim 9, wherein the first and second electrodes have respective rectangular cross-sections transverse to the direction of relative movement of the first and second electrodes.

14. A persistent current circuit switch comprising first and second electrodes contacting and separating from each other, an end of the first electrode contacting an end of the second electrode to close the switch, wherein the end of the first electrode is convex, the end of the second electrode is concave, receives the end of the first electrode for closing the switch, has a central recess extending partially into the second electrode, reducing rigidity of the end of the second electrode so that an area of contact between the first and second electrodes when the first and second electrodes are brought into contact with each other is increased.

15. The persistent current circuit switch as claimed in claim 14, wherein the end of the first electrode has a hemispherical shape and the end of the second electrode has an inverse conical or hemispherical shape.

16. The persistent current circuit switch as claimed in claim 14, wherein the recess has a U-shape in a cross-section taken parallel to a direction of relative movement of the first and second electrodes for contacting each other and separating from each other.

17. The persistent current circuit switch as claimed in claim 14, including a notch transverse to the recess in an outer surface of at least one of the first and second electrodes.

18. The persistent current circuit switch as claimed in claim 14, wherein the first and second electrodes have respective circular cross-sections transverse to the direction of relative movement of the first and second electrodes.

* * * * *